US011441520B2

(12) United States Patent
Rohrssen et al.

(10) Patent No.: US 11,441,520 B2
(45) Date of Patent: Sep. 13, 2022

(54) METHOD OF DETERMINING AN OPERATIONAL STATUS OF AN EGR VALVE

(71) Applicant: VOLVO TRUCK CORPORATION, Gothenburg (SE)

(72) Inventors: Karsten Rohrssen, Gråbo (SE); Neelam Bhamra, Gothenburg (SE); Amanda Larsson, Borås (SE); Katarina Raaholt Larsson, Mölndal (SE); Rucha Wagh, Gothenburg (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 17/643,306

(22) Filed: Dec. 8, 2021

(65) Prior Publication Data

US 2022/0195968 A1 Jun. 23, 2022

(30) Foreign Application Priority Data

Dec. 17, 2020 (EP) ..... 20215105

(51) Int. Cl.
*F02M 26/00* (2016.01)
*F02M 26/49* (2016.01)
*F02D 41/00* (2006.01)

(52) U.S. Cl.
CPC ..... *F02M 26/49* (2016.02); *F02D 41/0077* (2013.01); *F02D 2200/0414* (2013.01)

(58) Field of Classification Search
CPC ..... F02M 26/49; F02D 41/0077; F02D 2200/0414
See application file for complete search history.

(56) References Cited

U.S. PATENT DOCUMENTS 6,085,732 A 7/2000 Wang et al.
6,446,498 B1 * 9/2002 Schricker ..... F02M 26/28 73/114.37

(Continued)

FOREIGN PATENT DOCUMENTS

EP 2733341 A1 5/2014
JP H01170750 A 7/1989

(Continued)

OTHER PUBLICATIONS

European Search Report dated Jun. 1, 2021 in corresponding European Patent Application No. 20215105.6, 8 pages.

*Primary Examiner* — Phutthiwat Wongwian
*Assistant Examiner* — Sherman D Manley
(74) *Attorney, Agent, or Firm* — Venable LLP; Jeffri A. Kaminski

(57) ABSTRACT

A method of determining an operational status of an exhaust gas recirculation valve of an internal combustion engine arrangement, the EGR valve being configured to control a flow of combusted exhaust gas from an exhaust manifold to an inlet manifold of the ICE arrangement. The method comprising controlling the EGR valve to transition from a closed position; obtaining a signal indicative of a variation of temperature level of the gas present in the inlet manifold at a duration between a first point in time and a second point in time when the EGR valve assumes the open position; determining, based on the signal indicative of the variation of the temperature level, a velocity value indicative of a maximum increase in change of temperature level during the time period between the first point in time and the second point in time; comparing the velocity value with a predetermined threshold; and determining that the EGR valve is operational when the velocity value is higher than the predetermined threshold.

13 Claims, 3 Drawing Sheets

(56) References Cited

U.S. PATENT DOCUMENTS

| | | | | |
|---|---|---|---|---|
| 9,389,144 | B2 * | 7/2016 | Han | F02M 26/49 |
| 9,926,866 | B2 * | 3/2018 | Lahti | F02M 26/19 |
| 10,227,935 | B2 * | 3/2019 | Ogata | F02D 41/005 |
| 2003/0041845 | A1 | 3/2003 | Akao et al. | |
| 2007/0266999 | A1 * | 11/2007 | Clarke | F02M 26/25 165/103 |
| 2012/0290190 | A1 | 11/2012 | Kim et al. | |
| 2012/0318247 | A1 * | 12/2012 | Nogami | F02D 41/0077 123/568.19 |
| 2013/0068203 | A1 * | 3/2013 | Hawkins | F02M 26/49 123/568.16 |
| 2016/0230683 | A1 * | 8/2016 | Surnilla | F02M 26/08 |
| 2016/0230684 | A1 * | 8/2016 | Surnilla | F02D 41/0077 |
| 2017/0074178 | A1 * | 3/2017 | Ogata | F02D 41/401 |
| 2018/0245546 | A1 * | 8/2018 | Haga | F02M 26/47 |

FOREIGN PATENT DOCUMENTS

| | | | |
|---|---|---|---|
| JP | H0835449 | A | 2/1996 |
| JP | 2006291921 | A | 10/2006 |

* cited by examiner

METHOD OF DETERMINING AN OPERATIONAL STATUS OF AN EGR VALVE

TECHNICAL FIELD

The present disclosure relates to a method of determining an operational status of an exhaust gas recirculation (EGR) valve of an internal combustion engine arrangement. The present disclosure also relates to a control unit configured to determine the operational status of the exhaust gas recirculation valve. Although the method and control unit are mainly described in relation to a heavy-duty vehicle, also commonly referred to as a truck, they may also be applicable to other types of vehicles incorporating EGR valves for directing heated exhaust gas from an exhaust gas manifold to an inlet manifold of an internal combustion engine arrangement.

BACKGROUND

In relation to internal combustion engine (ICE) arrangements, recirculation of exhaust gas is a conventional technology for heating the air supplied to the combustion cylinders during operation. During recirculation of exhaust gas, commonly referred to as exhaust gas recirculation (EGR), a portion of the exhaust gas in an exhaust manifold of the ICE is recirculated to an inlet manifold of the ICE, via an EGR conduit. Hereby, the relatively warm exhaust gas is, in combination with ambient air, supplied to the combustion cylinders. This dilutes the oxygen in the incoming air flow and provides gases which are inert to the combustion process thereby reducing peak in-cylinder temperatures.

The flow of exhaust gas from the exhaust manifold to the inlet manifold is controlled by an EGR valve positioned in the EGR conduit. As this EGR valve is exposed to the harsh exhaust gases, there is a risk that it is not able to always operate as desired. It is possible to determine the operational status of the EGR valve by means of e.g. EGR flow sensors that measures the flow of exhaust passing through the EGR valve.

However, such EGR flow sensors are expensive and could potentially also malfunction for various reasons. There is thus a desire to be able to determine the operational status of the EGR valve by other measures.

SUMMARY

It is an object of the present disclosure to describe a method which at least partially overcomes the above described deficiencies. This is achieved by a method according to claim 1.

According to a first aspect, there is provided a method of determining an operational status of an exhaust gas recirculation (EGR) valve of an internal combustion engine (ICE) arrangement, the EGR valve being configured to control a flow of combusted exhaust gas from an exhaust manifold to an inlet manifold of the ICE arrangement, the method comprising controlling the EGR valve to transition from a closed position, in which combusted exhaust gas is prevented from reaching the inlet manifold, to an open position, in which combusted exhaust gas is allowed to flow from the exhaust manifold to the inlet manifold; obtaining a signal indicative of a variation of temperature level of the gas present in the inlet manifold at a duration between a first point in time and a second point in time when the EGR valve assumes the open position; determining, based on the signal indicative of the variation of the temperature level, a velocity value indicative of a maximum increase in change of temperature level during the time period between the first point in time and the second point in time; comparing the velocity value with a predetermined threshold; and determining that the EGR valve is operational when the velocity value is higher than the predetermined threshold.

The velocity value should be construed as a velocity of the increase in temperature. Thus, the velocity value indicates an increase, i.e. how fast, the temperature changes between points in time during the time period between the first point in time and the second point in time. In further detail, the velocity value can also be referred to as the derivative of the temperature during the time period between the first and second points in time.

Also, the operational status should be construed as whether the EGR valve passes through a sufficient flow of combustion gases, i.e. is operational, or if the EGR valve fails to pass through a sufficient flow of combustion gases, i.e. it is not operational, or partly operational. As the EGR valve is positioned in a harsh environment, it can clog which can result in that it is not able to sufficiently let the exhaust gas pass through to the inlet manifold.

The present invention is based on the unexpected insight that an increased change in temperature at the inlet manifold is proportional to the flow of exhaust gas from the exhaust manifold to the inlet manifold. Thus, by comparing the increase change, i.e. the derivative of the temperature during a time period when the EGR valve is arranged in an open position, it can be determined whether the EGR valve passes through a sufficient amount of exhaust gas, or if the EGR valve is not sufficiently operable, i.e. it is partly, or fully, malfunctioning. An advantage is thus that a rapid and robust method for determining the operational status of the EGR valve is provided. The need for additional expensive and less robust EGR sensors can thus be reduced. Accordingly, and according to an example embodiment, the EGR valve may be determined to be malfunctioning when the velocity value is below the predetermined threshold.

According to an example embodiment, the method may further comprise determining an openness degree of the EGR valve; and determining the velocity value of the increase in change of temperature from the first point in time initiated when the openness degree exceeds a predetermined openness limit. Hereby, it can be assured that the method is operated when the EGR valve is open and should, if operational, generate a relatively high temperature derivative. As such, and according to an example embodiment, the second point in time may occur when the openness degree of the valve subsequently falls below the predetermined openness limit. Thus, the measurement/detection of the velocity signal is ended when the EGR valve is closed, or when open to a less degree.

According to an example embodiment, the ICE arrangement may comprise a temperature sensor arranged to measure the temperature level of the gas present in the inlet manifold.

According to an example embodiment, the method may further comprise determining, based on the signal indicative of the variation of the temperature level, an acceleration value indicative of an acceleration of a gas temperature change between the first and second points in time; and setting the velocity value indicative of the maximum increase in change of temperature as a velocity value obtained when the acceleration value is reduced to a predetermined acceleration limit.

Thus, by determining the acceleration of the temperature change in the inlet manifold, a maxima of the velocity of the temperature change, i.e. the derivative, can be determined. Hereby, the maxima can be more rapidly identified. According to an example embodiment, the predetermined acceleration limit may be within a range between −0.5° C./$s^2$ and 0.5° C./$s^2$, preferably the predetermined acceleration limit is 0° C./$s^2$.

According to a second aspect, there is provided a control unit configured to determine an operational status of an exhaust gas recirculation (EGR) valve of an internal combustion engine (ICE) arrangement, the control unit being connected to the EGR valve for controlling operation of the EGR valve, and to a temperature sensor configured to measure temperature of gas present in an inlet manifold of the ICE arrangement, wherein the control unit comprises control circuitry configured to control the EGR valve to transition from a closed position, in which combusted exhaust gas is prevented from reaching the inlet manifold, to an open position, in which combusted exhaust gas is allowed to flow from an exhaust manifold of the ICE arrangement to the inlet manifold; obtain a signal from the temperature sensor, the signal being indicative of a variation of temperature level of the gas present in the inlet manifold at a duration between a first point in time and a second point in time when the EGR valve assumes the open position; determine, based on the signal indicative of the variation of the temperature level, a velocity value indicative of a maximum increase in change of temperature during the time period between the first point in time and the second point in time; compare the velocity value with a predetermined threshold; and determine that the EGR valve is operational when the velocity value is higher than the predetermined threshold.

Effects and features of the second aspect are largely analogous to those described above in relation to the first aspect. Thus, the steps defined in relation to the embodiments of the first aspect can be executed by the control unit of the second aspect.

According to a third aspect, there is provided an internal combustion engine (ICE) arrangement comprising an inlet manifold, an exhaust manifold, an exhaust gas recirculation (EGR) valve configured to control a flow of combusted exhaust gas from the exhaust manifold to the inlet manifold, a temperature sensor configured to measure temperature of gas present in an inlet manifold, and a control unit according to the second aspect, wherein the control unit is connected to the EGR valve for controlling operation of the EGR valve, and to the temperature sensor for receiving temperature signals from the temperature sensor.

According to a fourth aspect, there is provided a vehicle comprising an internal combustion engine according to third aspect.

According to a fifth aspect, there is provided a computer readable medium carrying a computer program comprising program code means for performing the steps of any one of the embodiments described above in relation to the first aspect when the program means is run on a computer.

According to a sixth aspect, there is provided a computer program comprising program code means for performing the steps of any one of the embodiments described above in relation to the first aspect when the program is run on a computer.

Effects and features of the third, fourth, fifth and sixth aspects are largely analogous to those described above in relation to the first aspect.

Further features of, and advantages will become apparent when studying the appended claims and the following description. The skilled person will realize that different features may be combined to create embodiments other than those described in the following, without departing from the scope of the present disclosure.

BRIEF DESCRIPTION OF THE DRAWINGS

The above, as well as additional objects, features and advantages, will be better understood through the following illustrative and non-limiting detailed description of exemplary embodiments, wherein.

DETAILED DESCRIPTION

Figure 1:
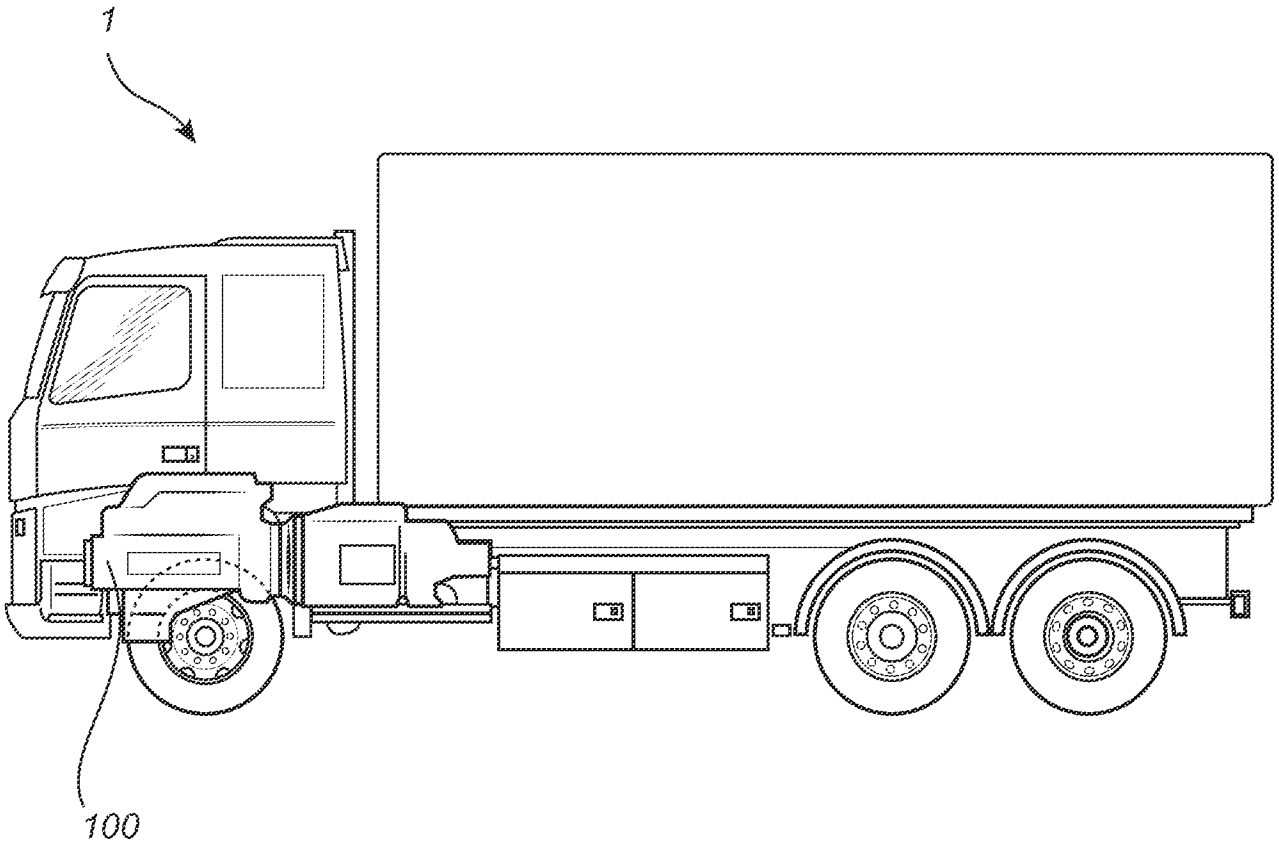
FIG. 1 is a side view illustrating a vehicle in the form of a truck according to an example embodiment.

The present disclosure will now be described more fully hereinafter with reference to the accompanying drawings, in which exemplary embodiments are shown. The disclosure may, however, be embodied in many different forms and should not be construed as limited to the embodiments set forth herein; rather, these embodiments are provided for thoroughness and completeness. Like reference character refer to like elements throughout the description.

Figure 2:
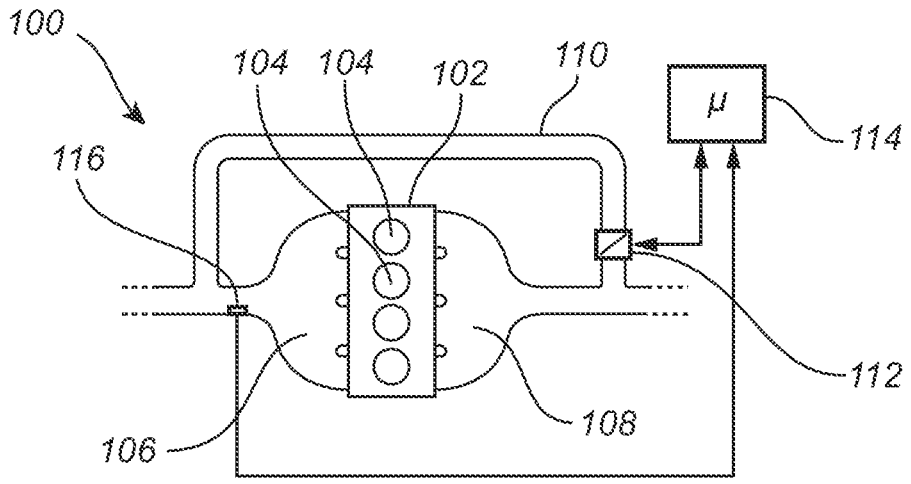
FIG. 2 illustrates an internal combustion engine arrangement according to an example embodiment.

With reference to FIG. 1, which is a side view illustrating a vehicle 1 in the form of a truck. The vehicle comprises an internal combustion engine (ICE) arrangement 100 for propulsion of the vehicle 1. The ICE arrangement 100 is depicted in further detail with reference to FIG. 2 and described in the following. As can be seen in FIG. 2, the ICE arrangement comprises an ICE 102 provided with a plurality of combustion cylinders 104 in which a conventional combustion process of the ICE takes place. The ICE arrangement 100 further comprises an inlet manifold 106 arranged to receive air and to convey the air into the combustion cylinders 104 for the combustion process, an exhaust manifold 108 arranged to receive combusted exhaust gas from the combustion cylinder after the combustion process within the combustion cylinders 104. The ICE also comprises an exhaust gas recirculation (EGR) circuit 110 extending between the exhaust manifold 108 and the inlet manifold 106. In particular, the EGR circuit 110 is arranged to convey the warm combusted exhaust gas from the exhaust manifold into the inlet manifold, where the combusted exhaust gas is mixed with ambient air, which mixture is supplied into the combustion cylinders.

In order to control the supply of combusted exhaust gas from the exhaust manifold 108 to the inlet manifold 106, the ICE arrangement 100 comprises an EGR valve 112. The EGR valve is connected to a control unit 114. Hereby, the control unit 114 controls opening and closing of the EGR valve 112, and thus controls when the flow of combusted exhaust gas should be conveyed from the exhaust manifold 108 to the inlet manifold 106.

The control unit 114 comprises control circuitry which may each include a microprocessor, microcontroller, programmable digital signal processor or another programmable device. The control circuitry may also, or instead, each include an application specific integrated circuit, a programmable gate array or programmable array logic, a programmable logic device, or a digital signal processor. Where the control circuitry includes a programmable device such as the microprocessor, microcontroller or programmable digital signal processor mentioned above, the processor may further include computer executable code that controls operation of the programmable device. It should be understood that all or some parts of the functionality provided by means of the control circuitry may be at least partly integrated with the control unit for executing the below described method.

Moreover, the ICE arrangement 100 comprises a temperature sensor 116 configured to measure the temperature of the gas, i.e. air and/or mixture of air and combusted exhaust gas, present in the inlet manifold 106. The temperature sensor 116 is connected to the control unit 116 for transmitting a signal indicative of the temperature at the inlet manifold 106 to the control unit.

Figure 3:
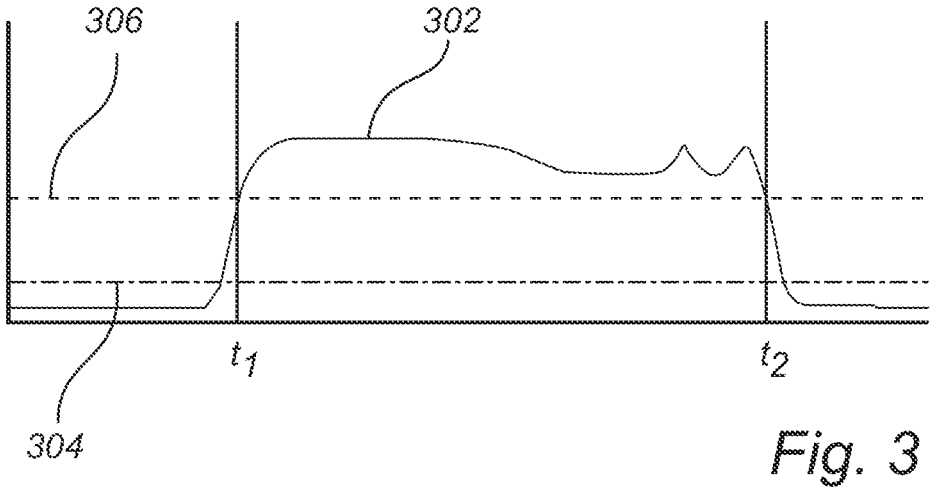
FIG. 3 is a graph illustrating the openness degree of the EGR valve.
Figure 4:
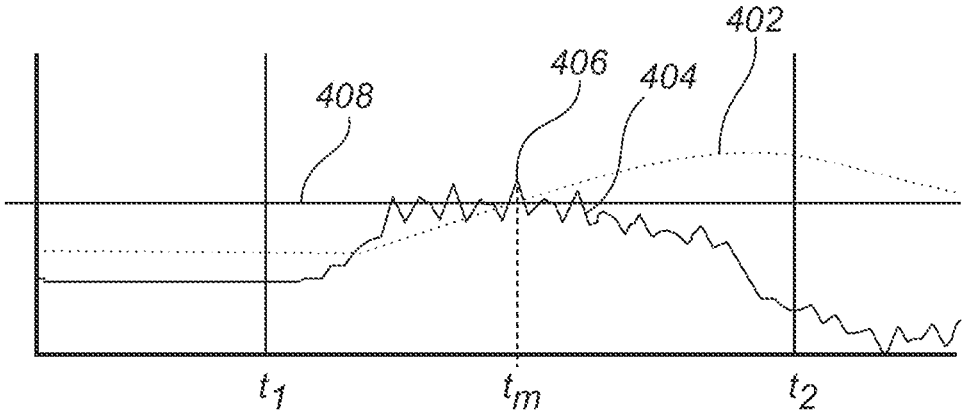
FIG. 4 is a graph illustrating a variation of the temperature level and a change in temperature level at the inlet manifold.

Since the EGR valve 112 is exposed to a relatively harsh environment, there is a risk that the EGR valve may not always function properly and thus not sufficiently convey combusted exhaust gas to from the exhaust manifold 108 to the inlet manifold 106 as desired. Reference is therefore made to FIGS. 3 and 4 in order to describe a method of determining the operational status of the EGR valve 112 according to an example embodiment.

FIG. 3 is a graph illustrating the openness degree of the EGR valve, while FIG. 4 is a graph illustrating a variation of the temperature level and a change in temperature level at the inlet manifold. In particular, the openness degree of the EGR valve 112 is denoted with 302 in FIG. 3. The graph comprises a lower openness threshold limit 304. When the openness degree 302 of the EGR valve 112 is below the lower openness threshold limit 304, the EGR valve 112 is considered to be arranged in a closed position in which combusted exhaust gas is prevented from reaching the inlet manifold 106. The graph also comprises an upper openness threshold limit 306. When the openness degree 302 of the EGR valve 112 is above the upper openness threshold limit 306, the EGR valve 112 is considered to be open to such an extent as to, for an operational and fully functional EGR valve 112, pass through a sufficient flow of combusted exhaust gas to the inlet manifold 106.

The present disclosure is thus configured to operate within the time period between a first point in time t1, which is a point in time when the openness degree 302 of the EGR valve 112 exceeds the upper openness threshold limit 306, to a second point in time t2, which is a point in time when the openness degree 302 of the EGR valve 112 falls below the upper openness threshold limit 306.

During the time period between the first point in time t1 and the second point in time t2, the control unit 114 receives signals from the temperature sensor 116, which signals are indicative of the temperature level at the inlet manifold. This temperature level, and in particular the variation in temperature is depicted by the dotted line 402 in FIG. 4. In particular, the control unit 114 obtains a variation of the temperature level at the inlet manifold 106 during the time period between the first point in time t1 and the second point in time t2. Based on the variation of the temperature, the control unit 114 determines a velocity value 404 of the increase in temperature. This velocity value thus indicates a speed of temperature increase at the inlet manifold at incremental time periods, i.e. the velocity value indicates a derivative of the temperature variation.

In particular, the control unit is configured to determine a velocity value which is indicative of a maximum 406 increase in change of temperature lever, the maximum derivative value of the temperature between the first t1 and second t2 points in time. As can be seen in FIG. 4, this occurs at a point in time $t_m$.

It has been unexpectedly realized that the derivative of the temperature in the exhaust manifold 106 is proportional to the flow of combusted exhaust gas from the exhaust manifold 108. Therefore, the maximum value 406 is compared with a predetermined threshold 408. If the maximum value 406 is higher than the predetermined threshold 408, the EGR valve 112 is considered to be operational, i.e. the EGR valve 112 passes through a sufficient flow of combusted exhaust gas. On the other hand, if the maximum value 406 is lower than the predetermined threshold 408, the EGR valve 112 is considered to be malfunctioning, i.e. the EGR valve 112 does not pass through a sufficient flow of combusted exhaust gas, and needs maintenance or replacement.

According to an example, the point in time $t_m$ can be determined by determining an acceleration value of the temperature during the time period between the first point in time t1 and the second point in time t2. In detail, the acceleration value presents an indication of how the temperature level accelerates at the inlet manifold. The velocity value can hereby be identified as the point in time $t_m$ when the acceleration value is reduced to a predetermined acceleration limit. The predetermined acceleration limit is preferably within the range −0.5° C./$^{s2}$ and 0.5° C./$^{s2}$, more preferably the predetermined acceleration limit is 0° C./$^{s2}$. By determining the point in time when the predetermined acceleration limit is close to 0° C./$^{s2}$, a maxima of the temperature derivative can be found.

Figure 5:
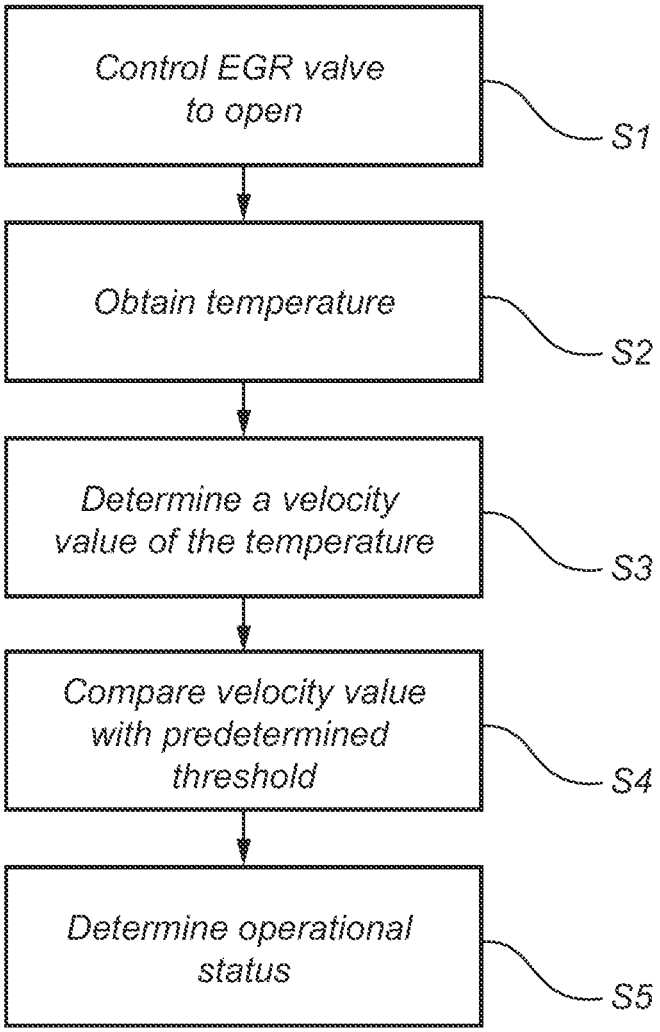
FIG. 5 is a flow chart of a method according to an example embodiment.

In order to sum up, reference is made to FIG. 5 which is a flow chart of determining the operational status of the EGR valve 112 according to an example embodiment. During operation, the control unit 114 controls S1 the EGR valve 112 to transition from a closed position to an open position. The control unit 116 obtains S2 a signal from the temperature sensor 106 which is indicative of the variation 402 of the temperature level of the gas present in the inlet manifold at a duration between the first point in time t1 and the second point in time t2 when the EGR valve assumes the open position, i.e. the openness degree 302 of the valve is above the upper openness threshold limit 306.

The control unit 114 further, based on the signal indicative of the variation of the temperature level received from the temperature sensor 106, determines S3 a velocity value which is indicative of a maximum increase 406 in change of the temperature level during the time period between the first point in time and the second point in time. Hence, the control unit determines the derivative of the temperature variation between the first t1 and second t2 points in time. The velocity value is compared S4 with a predetermined threshold 408. Since the predetermined threshold indicates whether the EGR valve 112 is able to let a sufficient flow of combusted exhaust gas pass through, the control unit 114 can determine S5 that the EGR valve 112 is operational when the velocity value is higher than the predetermined threshold 408.

It is to be understood that the present disclosure is not limited to the embodiments described above and illustrated in the drawings; rather, the skilled person will recognize that many changes and modifications may be made within the scope of the appended claims.

The invention claimed is:

1. A method of determining an operational status of an exhaust gas recirculation valve of an internal combustion engine arrangement, the EGR valve being configured to control a flow of combusted exhaust gas from an exhaust manifold to an inlet manifold of the ICE arrangement, the method comprising:

controlling the EGR valve to transition from a closed position, in which combusted exhaust gas is prevented from reaching the inlet manifold, to an open position, in which combusted exhaust gas is allowed to flow from the exhaust manifold to the inlet manifold;

obtaining a signal indicative of a variation of temperature level of the gas present in the inlet manifold at a duration between a first point in time and a second point in time when the EGR valve assumes the open position;

determining, based on the signal indicative of the variation of the temperature level, a velocity value indicative of a maximum increase in change of temperature level during the time period between the first point in time and the second point in time;

comparing the velocity value with a predetermined threshold; and determining that the EGR valve is operational when the velocity value is higher than the predetermined threshold.

2. The method according to claim 1, wherein the EGR valve is determined to be malfunctioning when the velocity value is below the predetermined threshold.

3. The method according to claim 1, further comprising:

determining an openness degree of the EGR valve; and determining the velocity value of the increase in change of temperature from the first point in time initiated when the openness degree exceeds a predetermined openness limit.

4. The method according to claim 3, wherein the second point in time occurs when the openness degree of the valve subsequently falls below the predetermined openness limit.

5. The method according to claim 1, wherein the ICE arrangement comprises a temperature sensor arranged to measure the temperature level of the gas present in the inlet manifold.

6. The method according to claim 1, further comprising:

determining, based on the signal indicative of the variation of the temperature level, an acceleration value indicative of an acceleration of a gas temperature change between the first and second points in time; and setting the velocity value indicative of the maximum increase in change of temperature as a velocity value obtained when the acceleration value is reduced to a predetermined acceleration limit.

7. The method according to claim 6, wherein the predetermined acceleration limit is within a range between −0.5° C./$^{s2}$ and 0.5° C./$^{s2}$.

8. The method according to claim 6, wherein the predetermined acceleration limit is 0° C./$^{s2}$.

9. A control unit configured to determine an operational status of an exhaust gas recirculation valve of an internal combustion engine arrangement, the control unit being connected to the EGR valve for controlling operation of the EGR valve, and to a temperature sensor configured to measure temperature of gas present in an inlet manifold of the ICE arrangement, wherein the control unit comprises control circuitry configured to:

control the EGR valve to transition from a closed position, in which combusted exhaust gas is prevented from reaching the inlet manifold, to an open position, in which combusted exhaust gas is allowed to flow from an exhaust manifold of the ICE arrangement to the inlet manifold;

obtain a signal from the temperature sensor, the signal being indicative of a variation of temperature level of the gas present in the inlet manifold at a duration between a first point in time and a second point in time when the EGR valve assumes the open position;

determine, based on the signal indicative of the variation of the temperature level, a velocity value indicative of a maximum increase in change of temperature during the time period between the first point in time and the second point in time;

compare the velocity value with a predetermined threshold; and determine that the EGR valve is operational when the velocity value is higher than the predetermined threshold.

10. An internal combustion engine arrangement comprising an inlet manifold, an exhaust manifold, an exhaust gas recirculation valve configured to control a flow of combusted exhaust gas from the exhaust manifold to the inlet manifold, a temperature sensor configured to measure temperature of gas present in an inlet manifold, and a control unit according to claim 9, wherein the control unit is connected to the EGR valve for controlling operation of the EGR valve, and to the temperature sensor for receiving temperature signals from the temperature sensor.

11. A vehicle comprising an internal combustion engine according to claim 10.

12. A computer readable medium carrying a computer program comprising program code means for performing the steps of claim 1 when the program means is run on a computer.

13. A computer program comprising program code means for performing the steps of claim 1 when the program is run on a computer.

* * * * *